US007704046B1

(12) United States Patent
Liang

(10) Patent No.: US 7,704,046 B1
(45) Date of Patent: Apr. 27, 2010

(54) TURBINE BLADE WITH SERPENTINE COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 593 days.

(21) Appl. No.: 11/805,740

(22) Filed: May 24, 2007

(51) Int. Cl.
*F01D 5/18* (2006.01)

(52) U.S. Cl. ..... 416/96 R; 416/97 R

(58) Field of Classification Search ..... 415/115; 416/96 R, 97 R

See application file for complete search history.

(56) References Cited

U.S. PATENT DOCUMENTS 4,627,480 A * 12/1986 Lee ..... 164/369
6,036,440 A 3/2000 Tomita et al.
6,220,817 B1 4/2001 Durgin et al.
6,561,758 B2 5/2003 Rinck et al.
6,955,523 B2 10/2005 McClelland
6,966,756 B2 * 11/2005 McGrath et al. ..... 416/97 R
7,008,186 B2 * 3/2006 Heeg et al. ..... 416/97 R
7,094,031 B2 * 8/2006 Lee et al. ..... 416/97 R

* cited by examiner

*Primary Examiner*—Ninh H Nguyen
(74) *Attorney, Agent, or Firm*—John Ryznic

(57) ABSTRACT

A turbine blade with a 5-pass serpentine flow cooling circuit to provide cooling for the blade. A first leg of the serpentine circuit is formed along the leading edge region of the blade, while the last leg is formed along the trailing edge region. The serpentine flow circuit includes a first root turn and a second root turn and a cooling air collector cavity formed in the blade attachment region and between the two root turns. A first metering hole connects the first root turn with the collector cavity, and a second metering hole connects the second root turn with the collector cavity. A portion of the cooling air flow from the first root turn is diverted through the first metering hole and into the collector cavity. This diverted cooling air then flows through the second metering hole and into the second root turn to be rejoined with the cooling air than passed through the serpentine circuit in the mid-chord region. The recombined cooling air flow then passes up the last leg of the serpentine circuit and is discharged through a row of exit holes spaced along the trailing edge of the blade.

7 Claims, 4 Drawing Sheets

TURBINE BLADE WITH SERPENTINE COOLING CIRCUIT

BACKGROUND OF THE INVENTION

1. Field of the Invention

The present invention relates generally to fluid reaction surfaces, and more specifically to a turbine blade with a serpentine flow cooling circuit.

2. Description of the Related Art Including Information Disclosed Under 37 CFR 1.97 and 1.98

In a gas turbine engine, especially in an industrial gas turbine engine, a turbine section includes multiple stages of stator or guide vanes and rotor blades to extract mechanical energy from a hot gas flow passing through the turbine. Increasing the turbine inlet temperature can increase the turbine efficiency, and therefore the engine efficiency. However, the maximum turbine inlet temperature is limited to the material characteristics of the turbine airfoils, especially the first stage guide vanes and rotor blades, since these airfoils are exposed to the highest temperature.

In order to allow for a higher gas flow temperature, the turbine airfoils include complex internal cooling circuits to provide the maximum amount of cooling for the airfoil while making use of the minimum amount of cooling air in order to maximize the efficiency of the turbine and therefore the engine. Internal airfoil cooling circuits have been proposed with complex design in order to maximize the amount of cooling as well as minimize the amount of cooling air used in order to increase the turbine efficiency and to increase turbine airfoil life. A serpentine flow cooling circuit is a very efficient arrangement to provide for cooling within the airfoils sine the serpentine path winds back and forth within the airfoil to increase the path length for the cooling air. FIG. 1 shows a prior art first stage turbine blade external heat transfer coefficient (HTC) profile. As shown in FIG. 1, the airfoil leading edge and trailing edge as well as the forward region of the suction side surface experience high hot gas heat transfer coefficient while the mid-chord section of the airfoil is at a lower hot gas HTC than the leading edge (LE) and the trailing edge (TE) and forward suction side (S/S) sections.

FIG. 2 shows a cross section view of a prior art turbine blade with a 5-pass aft flowing serpentine cooling circuit for the second stage blade. FIG. 3 shows a top view of a cross section through the turbine blade of FIG. 2, and FIG. 4 shows a diagram of the cooling air passage through the turbine blade of FIG. 2. The serpentine cooling circuit of FIG. 2 includes a first leg channel 11 extending along the leading edge region of the blade, a second leg forming a down pass channel 12, a third leg 13 forming an up-pass channel, a fourth leg 14 forming another down pass channel, and a fifth or last leg 15 extending along the trailing edge region of the blade. A first blade tip turn 16 and a second blade tip turn 18 turn the cooling air from an up-pass channel into the adjacent down-pass channel. A first blade root turn 17 and second blade root turn 19 turns the cooling air from a down-pass channel into the adjacent up-pass channel. A cover plate 21 covers over passages in the root to force the cooling air to follow the serpentine circuit. A row of exit cooling holes 22 discharge cooling air form the last leg 15 out from the airfoil cooling circuit. For an aft flowing 5-pass serpentine cooling circuit used for the entire airfoil, the cooling air flows through the serpentine cooling channels, lowering the airfoil metal temperature while increasing the cooling air temperature. As the cooling air reaches the airfoil trailing edge region, it loses some cooling capability (due to a pickup pf heat while passing through the airfoil mid-chord region) and therefore induces a hot spot for the airfoil trailing edge metal temperature. Hot spots appearing on a turbine airfoil especially in an industrial turbine engine induce problems with oxidation, which significantly reduces the part life in the engine. Also, it over-cools the airfoil mid-chord section where the heat loads for that region are low. In order to achieve a uniform sectional metal temperature distribution, a re-distribution of cooling air within the 5-pass serpentine flow circuit is required.

It is therefore an object of the present invention to provide for a turbine airfoil with a serpentine flow cooling circuit that cools less of the airfoil mid-chord region while cooling more of the trailing edge region than the cited prior art turbine blade serpentine flow cooling circuit.

BRIEF SUMMARY OF THE INVENTION

A turbine blade with a 5-pass serpentine flow cooling circuit to provide cooling for the blade. The first leg of the serpentine circuit is located along the leading edge region of the blade while the last leg is located along the trailing edge region. The serpentine flow cooling circuit includes two metering holes located at the blade root turns, one bleed off metering hole located at the first root turn which is inline with the first serpentine down pass channel and a re-supply metering hole located at the second root turn which is inline with the third serpentine up-pass channel. A cooling air collector chamber is formed at the blade attachment region to transfer the bypass cooling air from the leading edge section to the trailing edge section.

DETAILED DESCRIPTION OF THE INVENTION

Figure 1:
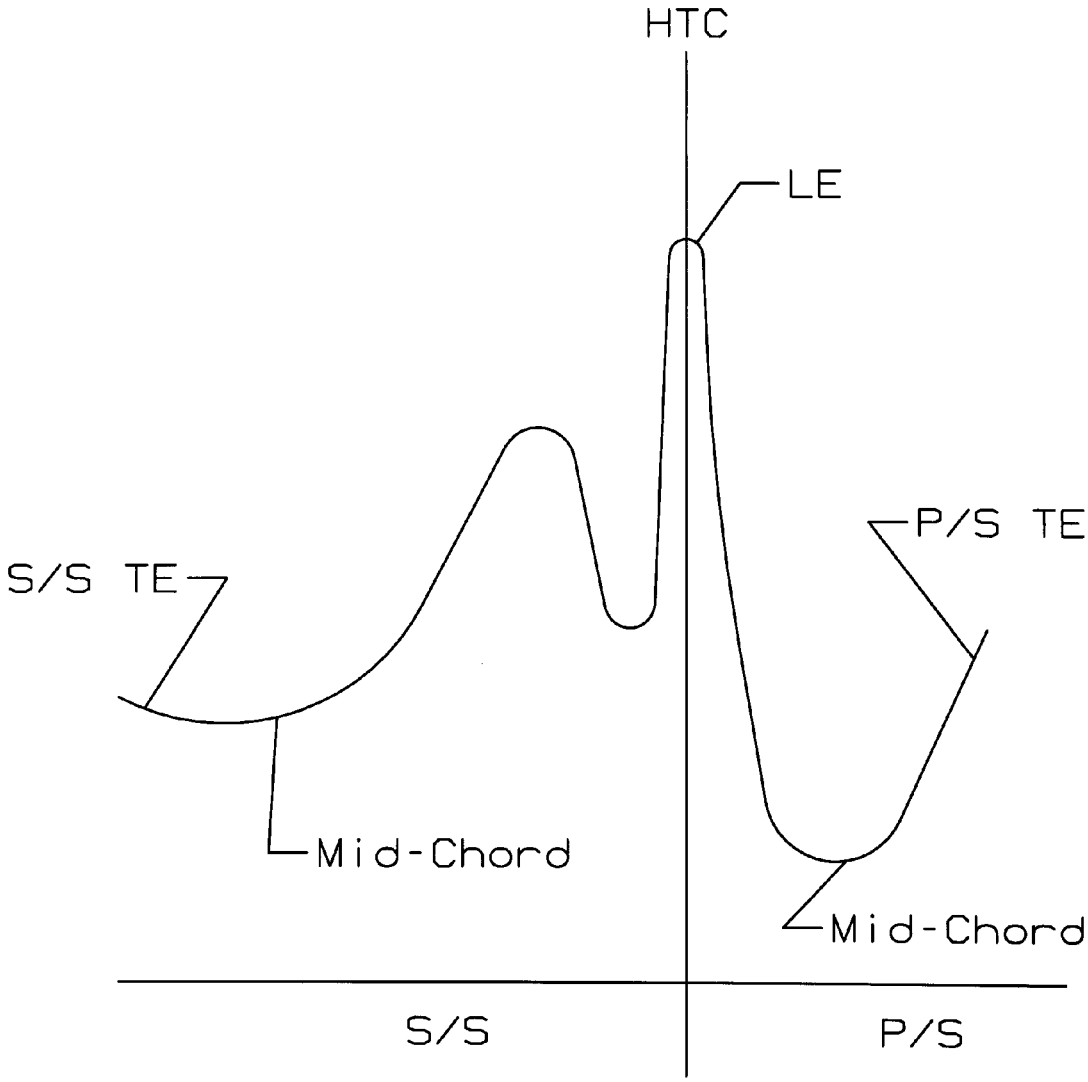
Fig 1 Prior Art
FIG. 1 shows graphical display of a prior art turbine blade external HTC distribution.
Figure 2:
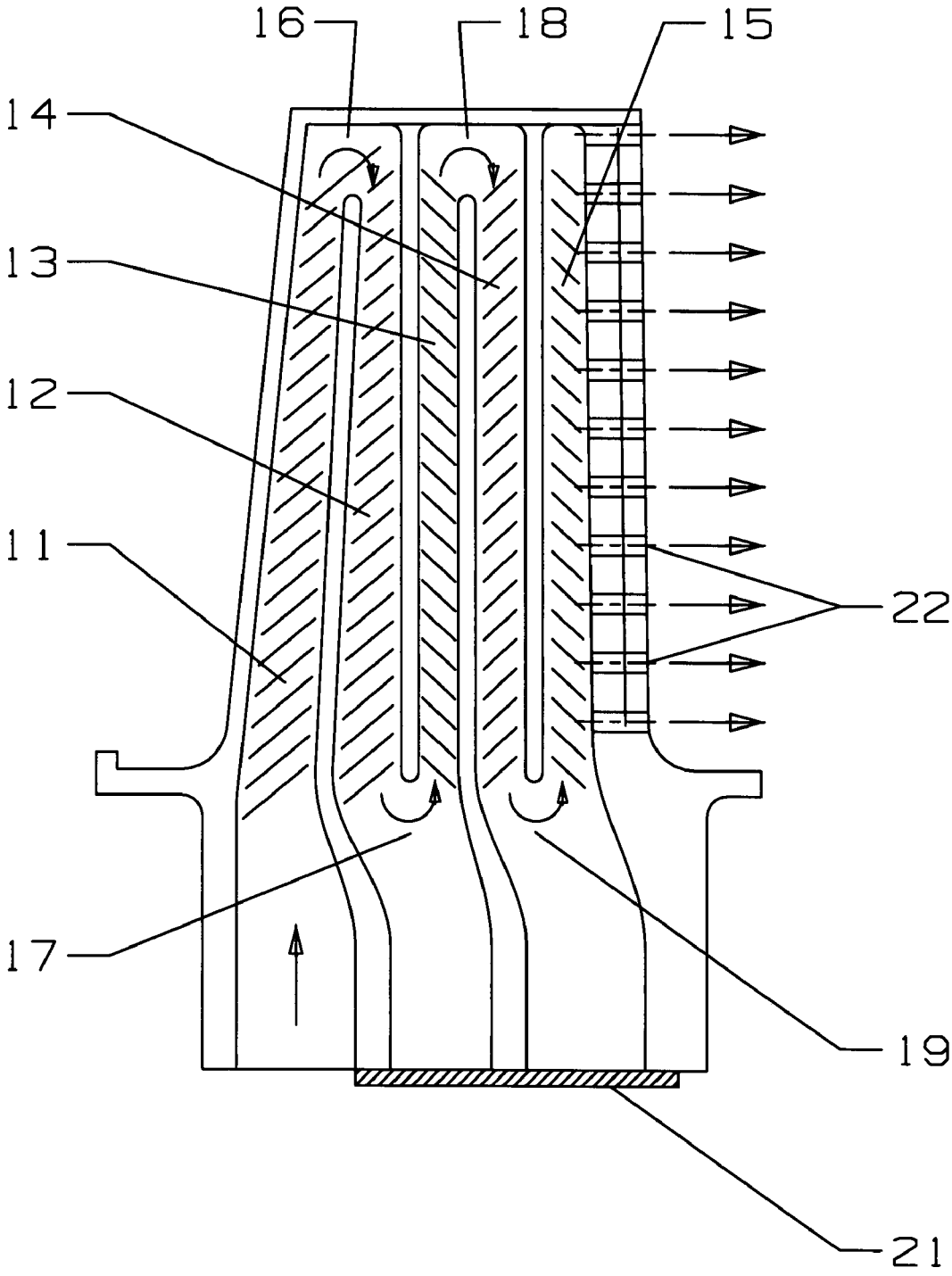
Fig 2 Prior Art
FIG. 2 shows a cross section view of a prior art turbine blade with a 5-pass aft flowing serpentine cooling circuit.
Figure 3:
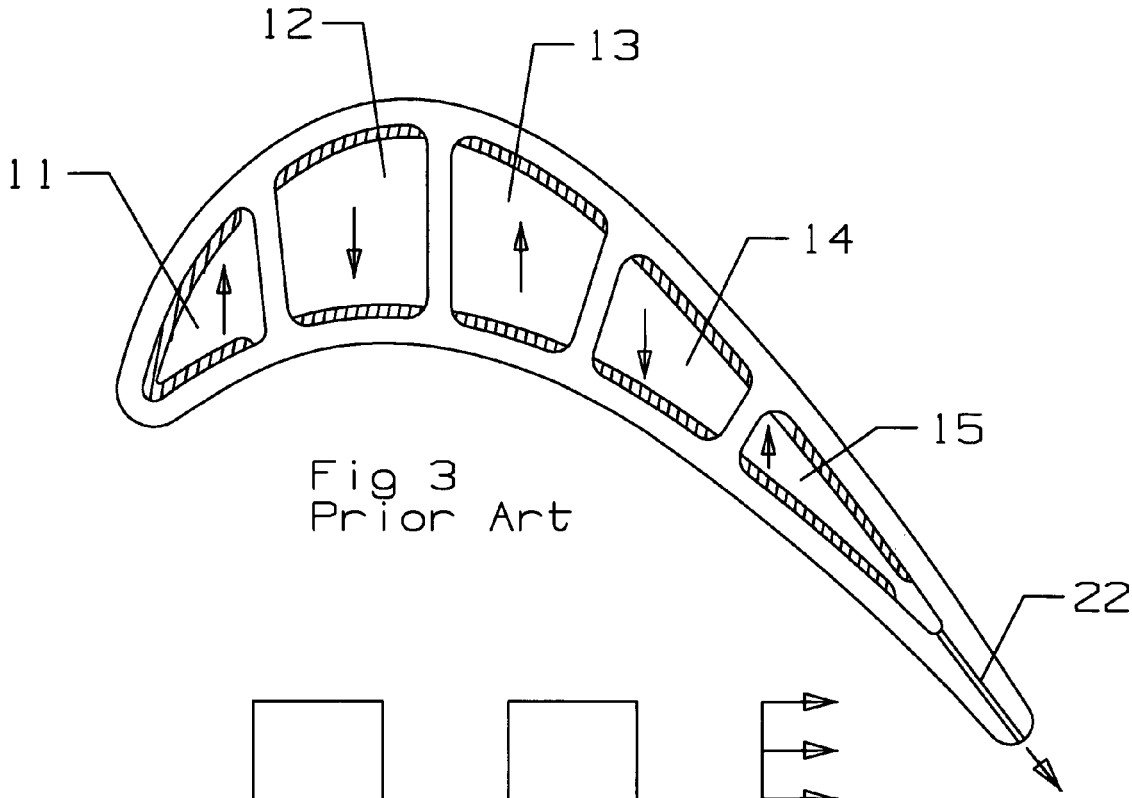
Fig 3 Prior Art
FIG. 3 shows top cross section view of the prior art turbine blade of FIG. 2.
Figure 4:
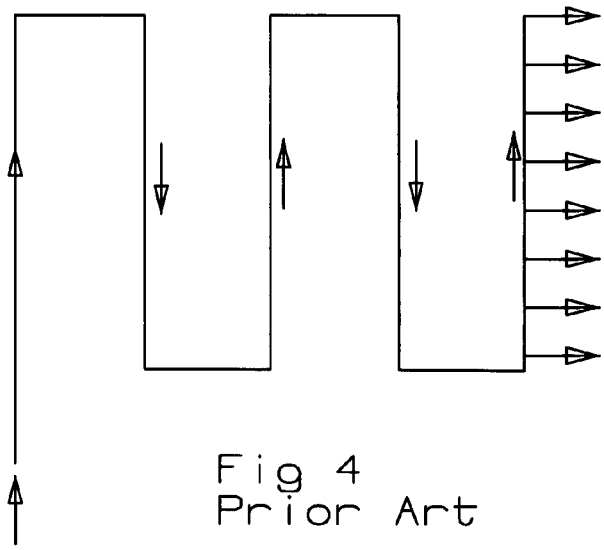
Fig 4 Prior Art
FIG. 4 shows a diagram of the cooling air flow of the prior art FIG. 2 turbine blade.
Figure 5:
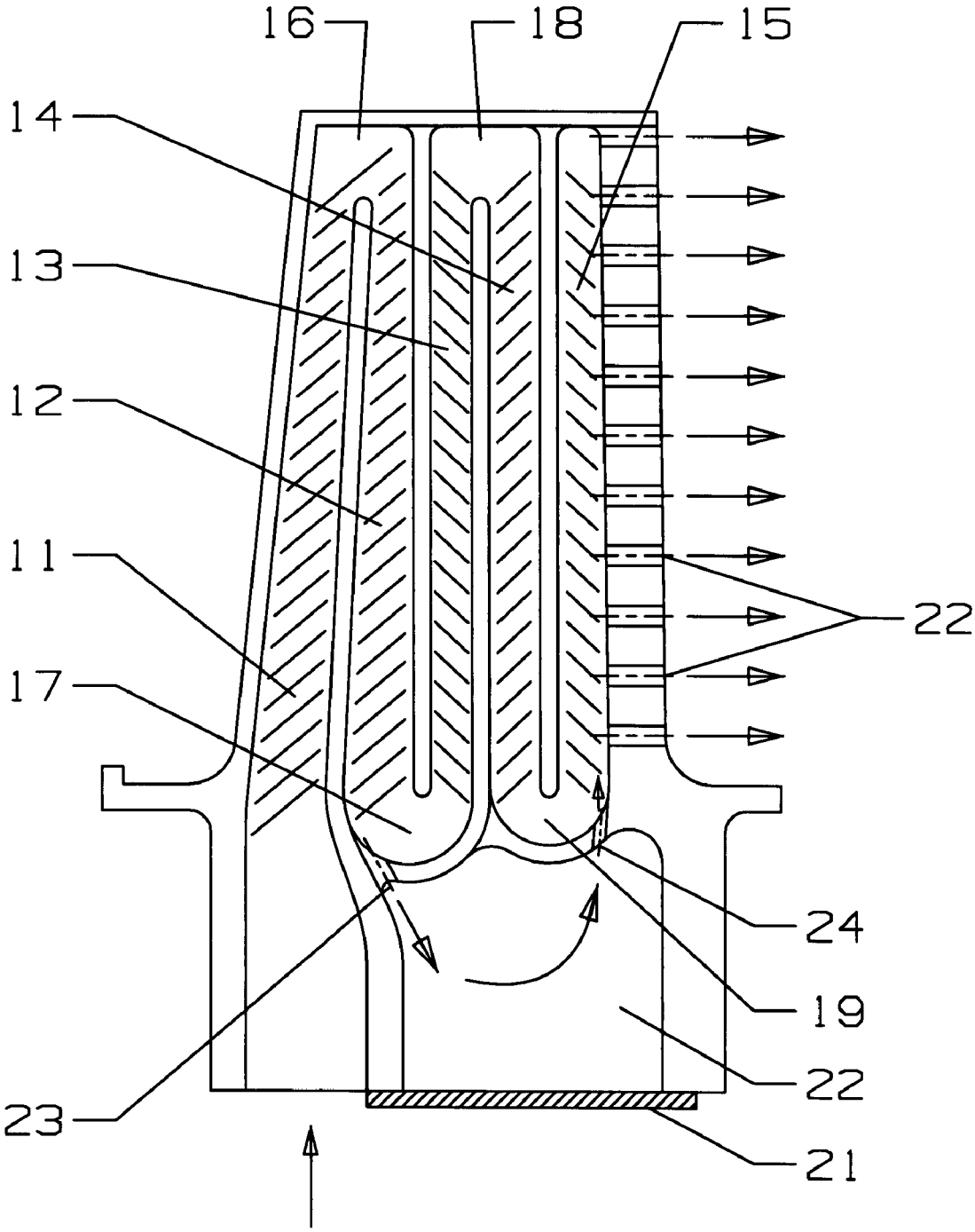
FIG. 5 shows a cross section side view of the serpentine flow cooling circuit of the present invention.

The present invention is shown in FIG. 5 and is a turbine blade used in a gas turbine engine, especially for an industrial gas turbine engine where oxidation is a major design factor in blade life. The turbine blade includes a 5-pass serpentine flow cooling circuit as in the earlier cited prior art blade. However, in the present invention the first and second root turns 17 and 19 have walls that block off the turns from a cooling air collector cavity or chamber 22 formed in the root section and covered by a cover plate 21. The first root turn 17 includes a first metering hole 23 located adjacent to the rib on the beginning of first turn. The second root turn 18 includes a second metering hole 24 located adjacent to the rib on the end of the second turn 19 as seen in FIG. 5.

The bleed off first metering hole 23 is located in the first root turn 17 inline with the first serpentine down pass channel 12. A re-supply metering hole 24 is located at the second root turn 19 that is inline with the third serpentine up-pass channel 15. The cooling air collector chamber 22 is formed at the blade attachment region to transfer the by-pass cooling air from the airfoil leading edge section to the trailing edge section.

In operation, the total cooling air is supplied through the airfoil leading edge serpentine flow channel 11 and serpentines down the first down pass channel 12 where the airfoil heat load is high. Since the heat load for the airfoil mid-chord region is lower than the leading edge region, less cooling air is required for cooling. A portion of the cooling air is bled off from the down pass serpentine flow channel at the root turn manifold and into the collector chamber 22. This by-pass cooling air is then injected back into the third up-pass serpentine flow channel 15 from the second root turn 19. The cooling flow circuit of the present invention eliminates the over-cooling of the airfoil mid-chord region and cooling air heat up which yields a better cooling potential for the trailing edge region cooling. The spent cooling air is then discharged along the trailing edge of the airfoil to provide cooling for that portion of the airfoil. A well thermally balanced airfoil cooling design is thus achieved.

I claim the following:

1. A turbine blade comprising:

a leading edge and a trailing edge;

a pressure side wall and a suction side wall extending between the leading and trailing edges;

a serpentine flow cooling circuit with a first root turn and a second root turn;

a cooling air collector chamber formed with the blade attachment region;

a first metering hole connecting the first root turn with the collection chamber; and, a second metering hole connecting the second root turn with the collector chamber.

2. The turbine blade of claim 1, and further comprising:

the first metering hole is located at the first root turn and inline with the first serpentine down pass channel.

3. The turbine blade of claim 1, and further comprising:

the second metering hole is located at the second root turn and inline with the third serpentine up-pass channel.

4. The turbine blade of claim 1, and further comprising:

the first root turn and the second root turn are formed by a wall blocking off the cooling air from the collector cavity such that cooling air can only flow between the turns and the collector cavity through the metering holes.

5. The turbine blade of claim 1, and further comprising:

the collector cavity is covered with a cover plate such that cooling air flows from the first metering hole and into the second metering hole.

6. A process for cooling a turbine blade, the turbine blade having a 5-pass serpentine flow cooling circuit with a first root turn and a second root turn, the process comprising:

supplying pressurized cooling air into the first leg of the serpentine flow circuit;

passing cooling air from the first down pass channel into the second up pass channel;

passing cooling air from the second down pass channel into the third up pass channel;

diverting a portion of the cooling air from the first root turn into a collector cavity; and, discharging the diverted cooling air into the second root turn.

7. The process for cooling a turbine blade of claim 6, and further comprising the step of:

discharging the cooling air from the last leg of the serpentine circuit through a row of exit holes.

* * * * *